US007318405B2

(12) United States Patent
Tanaka et al.

(10) Patent No.: US 7,318,405 B2
(45) Date of Patent: Jan. 15, 2008

(54) ENGINE FOR VEHICLE

(75) Inventors: Ichiro Tanaka, Kakogawa (JP); Yoshiharu Matsuda, Akashi (JP)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 0 days.

(21) Appl. No.: 11/519,795

(22) Filed: Sep. 13, 2006

(65) Prior Publication Data

US 2007/0062480 A1 Mar. 22, 2007

(30) Foreign Application Priority Data

Sep. 15, 2005 (JP) ..... P2005-268813

(51) Int. Cl.
*F01M 1/02* (2006.01)
*F01M 5/00* (2006.01)
*F02B 77/00* (2006.01)

(52) U.S. Cl. ..... 123/195 C; 123/196 R; 123/196 AB

(58) Field of Classification Search ..... 123/196 R, 123/196 A, 196 AB, 196 CP, 195 C, 198 E
See application file for complete search history.

(56) References Cited

U.S. PATENT DOCUMENTS 4,848,170 A * 7/1989 Inagaki et al. ..... 74/6
4,995,448 A * 2/1991 Inagaki et al. ..... 165/44
5,199,395 A * 4/1993 Mizumura et al. .... 123/196 AB
5,857,442 A * 1/1999 Sumi ..... 123/196 R
6,305,337 B1 * 10/2001 Sumi et al. ..... 123/179.25
6,543,476 B2 * 4/2003 Kazaoka ..... 137/538
2001/0015190 A1 * 8/2001 Kawamoto ..... 123/196 A
2003/0019464 A1 * 1/2003 Morii et al. ..... 123/198 R
2005/0016488 A1 * 1/2005 Kawakubo et al. ..... 123/192.2
2007/0062500 A1 * 3/2007 Arima et al. ..... 123/572

FOREIGN PATENT DOCUMENTS

JP 57-183509 A * 11/1982
JP 1-211609 8/1989

OTHER PUBLICATIONS

Carley, Larry. "Oil Pumps and Engine Lubrication." AA1Car Auto Diagnosis Repair Help. May 13, 2007. <http://www.aa1car.com/library/2005/us020516.htm>.*

* cited by examiner

*Primary Examiner*—Stephen K. Cronin
*Assistant Examiner*—Ka Chun Leung
(74) *Attorney, Agent, or Firm*—Wenderoth, Lind & Ponack, L.L.P.

(57) ABSTRACT

An engine for a vehicle for which the work of replacing an oil filter or an oil cooler is easily executed. The vehicle engine is provided with a crank case, a cylinder head having an exhaust passage outlet in a front face, an oil pan being independently formed from the crank case and attached to a lower surface of the crank case, an oil supply path communicating the oil pan with lubricated positions of the engine so as to circulate oil in the oil pan, an oil pump drawing the oil from the oil pan and pressure feeding the oil to the lubricated positions via the oil supply path, and an oil filter or an oil cooler interposed in the middle of the oil supply path and attached to a front face, a side face or a rear face of the oil pan.

8 Claims, 7 Drawing Sheets

ENGINE FOR VEHICLE

BACKGROUND OF THE INVENTION

1. Field of the Invention

The present invention relates to an engine for a vehicle, and more particularly to an engine for a vehicle having an oil supply system which is provided with an oil pan, an oil filter, an oil cooler and the like.

2. Prior Art

In this kind of engine for the vehicle, as described in Japanese Unexamined Patent Publication No. 1-211609, an oil filter is generally arranged in the middle of an oil supply path from an oil pump to a plurality of lubrication positions, and an oil cooler is arranged as occasion demands.

FIG. 8 is a front elevational view of an engine for a motor cycle showing an example of a prior art. An oil pan 103 is attached to a lower surface of a crank case 100, and an oil filter 104 and an oil cooler 105 are attached to a front face of a lower portion of the crank case 100 so as to be arranged side to side and to form a forward protruding shape. Further, there is a prior art in which the oil filter is attached to a lower surface of the oil pan attached to the lower surface of the crank case so as to form a downward protruding shape.

In the engine for the motor cycle, an exhaust pipe is generally arranged so as to extend rearward from a front side of the engine through a lower side of the engine. Particularly, as shown in FIG. 8, in a 4-cylinder engine in which four cylinders are arranged in a orthogonal direction (right and left direction) to a forward moving direction of the vehicle, four exhaust pipes 110 pass through a front side of the engine. Since most of the oil filter 104 and the oil cooler 105 are covered by these four exhaust pipes 110 from the front side, the exhaust pipes 110 form an obstacle when replacing the oil filter 104 and the oil cooler 105, and thus, an inordinate amount of work is involved with attaching and detaching the same.

In order to easily execute the work of replacing the oil filter 104 and the oil cooler 105 from the front side, it is necessary to pipe the exhaust pipe 110 in the front side of the engine so as to bypass the oil filter 104 and the oil cooler 105 in a front view. However, in the structure mentioned above, a length of an exhaust path becomes longer than necessary and the shape and layout of the exhaust pipe 110 are complicated, so that manufacturing of the exhaust pipe is difficult. Further, the lengths of the exhaust pipes are not approximately uniform.

Further, as shown in FIG. 8, in the structure in which both the oil filter 104 and the oil cooler 105 are attached to the front face of the crank case 100, it is necessary to form both a mounting portion for the oil filter 104 and a mounting portion for the oil cooler 105 in the crank case 100 itself. Further, it is necessary to form the oil passage communicating between the oil filter 104 and the oil cooler 105 in accordance with a die casting or the like, and manufacturing the crank case 100 is difficult.

SUMMARY OF THE INVENTION

The present invention was made by taking the problem mentioned above into consideration, and an object of the present invention is to easily execute the work of replacing (an attaching and detaching work) an oil filter or an oil cooler without complicating a shape and a layout of an exhaust pipe, by configuring an attached position of the oil filter or the oil cooler, and facilitating the manufacture thereof.

In order to achieve the object mentioned above, in accordance with the present invention, there is provided an engine for a vehicle comprising: a crank case; a cylinder head having an exhaust passage outlet in a front face thereof and provided in an upper side of the crank case; an oil pan for reserving lubricating oil of the engine therein, the oil pan being independently formed from the crank case and being attached to a lower surface of the crank case; an oil supply path communicating the oil pan with lubricated positions of the engine so as to circulate the oil in the oil pan; an oil pump drawing the oil from the oil pan and pressure feeding the oil to the lubricated positions via the oil supply path; and an oil filter or an oil cooler interposed in the middle of the oil supply path and attached to a front face, a side face or a rear face of the oil pan.

In accordance with the structure mentioned above, (1) since the oil filter or the oil cooler is attached to the oil pan and since the oil pan has a more simple shape than the crank case, and is also light and small, it is easy to form an oil filter mounting portion or an oil cooler mounting portion thereon, and it is also easy to manufacture the crank case.

(2) Since the oil filter or the oil cooler is positioned below a lower end of the crank case, even in the case that the oil filter or the oil cooler is attached to a front face of the oil pan, it is possible to arrange exhaust pipes extending downward along a front side of the cylinder past the crank case from the cylinder head without bending the exhaust pipes in a complicated manner to avoid the oil filter or the oil cooler, so that freedom to shape and lay out the exhaust pipes is increased. In other words, it is possible to easily execute the work of replacing the oil filter or the oil cooler without complicating the shape and the layout of the exhaust pipe.

(3) In the case that the oil filter or the oil cooler is attached to one of the right and left side faces or the rear face of the oil pan, it is possible to execute the work of replacing the oil filter or the oil cooler from the side portion of the vehicle while preventing the exhaust pipe from forming an obstacle. Further, the layout of the exhaust pipe is not complicated.

In the present invention, it is preferable that one of the oil filter and the oil cooler may be attached to the front face of the oil pan and the other may be attached to the front face of the lower portion of the crank case. The oil filter and the oil cooler may be arranged in such a manner so as to at least partly overlap in a lateral direction in a plan view.

In accordance with the structure mentioned above, in the structure in which the oil filter and the oil cooler are arranged in the front side of the engine, since the oil filter and the oil cooler are arranged so as to be divided into up and down positions, and are arranged to overlap at least partly in the lateral direction, it is possible to arrange the exhaust pipes in the front side of the engine in such a manner so as to bypass the oil filter and the oil cooler in the front view without bending the exhaust pipes in a complicated manner. It is possible to enlarge a bank angle of a motor cycle including an engine according to the present invention.

In the present invention, it is preferable that an oil passage pipe independent from the crank case and the oil pan be used as a constituting member of an oil supply path from a discharge port of the oil pump to the oil filter or to the oil cooler attached to the oil pan. The oil passage pipe may be arranged within a space formed by the crank case and the oil pan.

In accordance with the structure mentioned above, it is possible to simplify the structure of the oil supply path.

In the present invention, it is preferable for the oil passage pipe to be pinched (fixed) by the crank case and the oil pan from above and below respectively.

In accordance with the structure mentioned above, a special fixing metal member for fixing the oil passage pipe is not necessary, and the oil passage pipe can be simultaneously fixed in accordance with the assembling work of the oil pan, and can be easily attached and detached.

In the present invention, it is preferable that a relief valve is provided in the oil passage pipe.

In accordance with the structure mentioned above, it is not necessary to form the relief valve mounting portion in the crank case or the oil pan. It is possible to prevent the shapes of the crank case and the oil pan from being complicated, and it is possible to easily manufacture the crank case and oil pan.

BRIEF DESCRIPTION OF THE DRAWINGS

The above and other objects, features and advantages of the present invention will become more apparent from the following description taken in connection with the accompanying drawings.

DETAILED DESCRIPTION OF THE PREFERRED EMBODIMENTS

Attached FIGS. 1 to 7 show an example in which the present invention is applied to a parallel 4-cylinder engine for a motor cycle. A description will be given of an embodiment in accordance with the present invention on the basis of these drawings.

Outline of Engine

Figure 1:
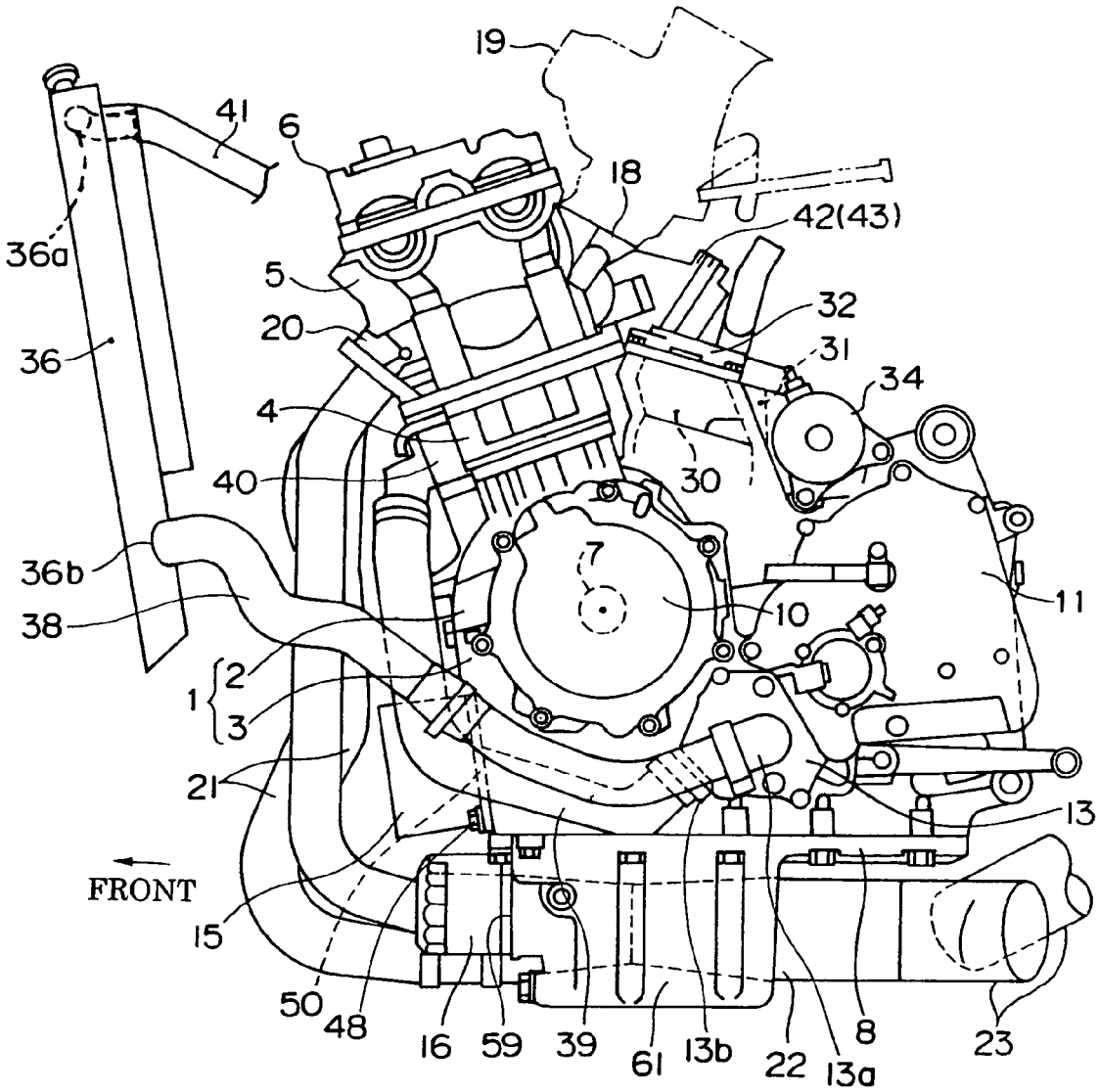
FIG. 1 is a left side elevational view of an embodiment of a 4 cylinder engine for a motor cycle to which the present invention is applied.

FIG. 1 is a left side elevational view of the engine, and the following description will be given by setting a direction of an axial length of a crank shaft 7 to a lateral direction (right and left direction), and setting a side in which a cylinder 4 is arranged to a vertical direction orthogonal to the axial length direction of the crank shaft 7 to a front side, for convenience of explanation. Specifically, a forward moving direction of a vehicle is set to the front side of the engine, and other directions (right, left and the like) are set to directions which a rider riding on the vehicle normally uses with reference to the front direction.

In FIG. 1, an outer shell of the engine is constituted by a crank case 1 having a vertically two-piece divided structure comprising an upper crank case member 2 and a lower crank case member 3, a cylinder (a cylinder block) 4 integrally formed with the upper crank case member 2 in an upper surface of a front end portion of the upper crank case member 2, a cylinder head 5 fastened to an upper surface of the cylinder 4, a head cover 6 fastened to an upper surface of the cylinder head 5, and an oil pan 8 fastened to a lower surface of the lower crank case member 3. A generator cover 10, an output chain cover (an output sprocket cover) 11 and the like are attached to a left end portion of the crank case 1, a water pump 13 is provided in a backward lower side of the generator cover 10, an oil cooler 15 is attached to an oil cooler mounting surface 50 in a front end of the lower crank case member 3, and an oil filter (a secondary oil filter) 16 is attached to an oil filter mounting surface 59 in a front end of the oil pan 8.

A radiator 36 is arranged in front of the cylinder 4 and the cylinder head 5, a cooling water outlet 36*b* in a lower end portion of the radiator 36 is connected to a suction port 13*a* of the cooling water pump 13 by a cooling water hose 38 extending rearward, a cooling water inlet 36*a* in an upper end portion of the radiator 36 is connected to a cooling water outlet portion 42 provided in a rear face of the cylinder head 5, and a thermostat 43 is installed in the cooling water outlet portion 42. A cooling water discharge port 13*b* of the cooling water pump 13 is connected to a cooling water inlet portion 40 formed in the front face of the cylinder 4 via the cooling water hose 39. The cooling water inlet portion 40 and the cooling water outlet portion 42 of the cylinder head 5 is communicated with a cooling water passage and a cooling water jacket (which are not illustrated) within the cylinder 4 and the cylinder head 5.

Intake passage inlets 18, open upward to the back, are formed in a rear face of the cylinder head, 5 per each cylinder, and a throttle body (or a carburetor) 19 is connected to each of the intake passage inlets 18. Exhaust passage outlets 20, open forward, are formed for each cylinder. An exhaust pipe 21 is connected to each of the exhaust passage outlets 20.

A breather chamber 30 and a balancer chamber 31 are arranged from a back surface of the cylinder over an upper surface of the upper crank case member 2 so as to line up from side to side, and the cylinder 4 and the upper crank case member 2 are integrally formed. Both the chambers 30 and 31 are open at respective upper ends, and both the openings are closed by a lid 32 which is common to both the chambers 30 and 31. A starter motor 34 is attached to a rear side of the breather chamber 30.

Figure 2:
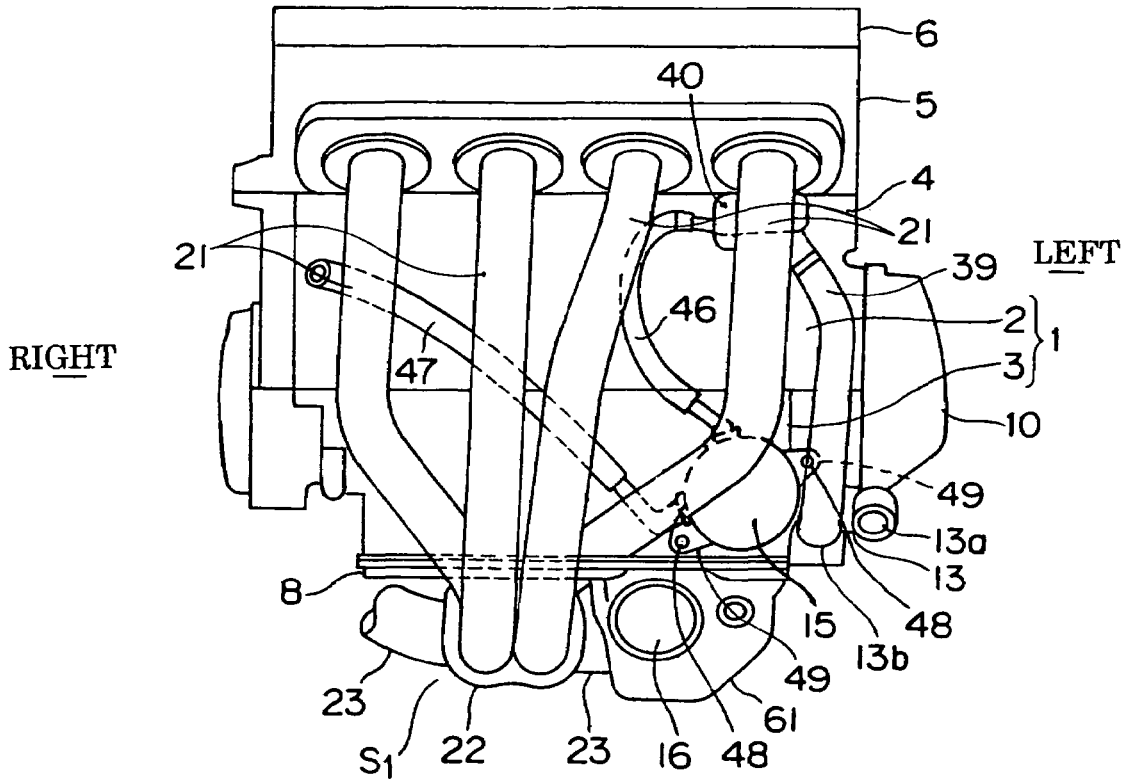
FIG. 2 is a front elevational view of the engine in FIG. 1.

FIG. 2 is a front elevational view of the engine in FIG. 1. The oil pan 8 is formed with a flat shallow portion and a concave portion 61 having a deep bottom forming a main oil reservoir which is formed in a left end portion of the oil pan 8. A lateral width of the concave portion 61 is approximately one third or more to about one half of the entire width of the oil pan 8, and the oil filter 16 is attached to a front face of the concave portion 61 so as to protrude forward. The oil cooler 15 is attached to a left end portion of the front face of the lower crank case member 3 so as to protrude forward, and is arranged so as to partially overlap the oil filter 16 in the lower side in the lateral direction in a plan view.

Four exhaust pipes 21 extending downward in front of the engine from the cylinder head 5 are focused to a front portion of a space portion S1 formed by a right side surface of the concave portion 61 of the oil pan 8 and a lower surface of the flat shallow portion of the oil pan 8, and are curved to a rear side. In the focusing process of the exhaust pipes 21, the leftmost exhaust pipe (the exhaust pipe for a first cylinder) 21 is bent at a forward position in a left end portion of the lower crank case member 3 so as to deflect to a right side from the oil filter 16 in a front view. On the basis of this layout of the exhaust pipe 21, the front side of the oil filter 16 attached to the front face of the concave portion 61 in the left end portion of the oil pan 8 is in an exposed state having no shielding. The oil cooler 15 is attached to the front face in the left end portion of the lower crank case member 3 so that a front side thereof is partly covered by the exhaust pipe 21. However, a half or more of the front side is in an exposed state in the front view.

Figure 3:
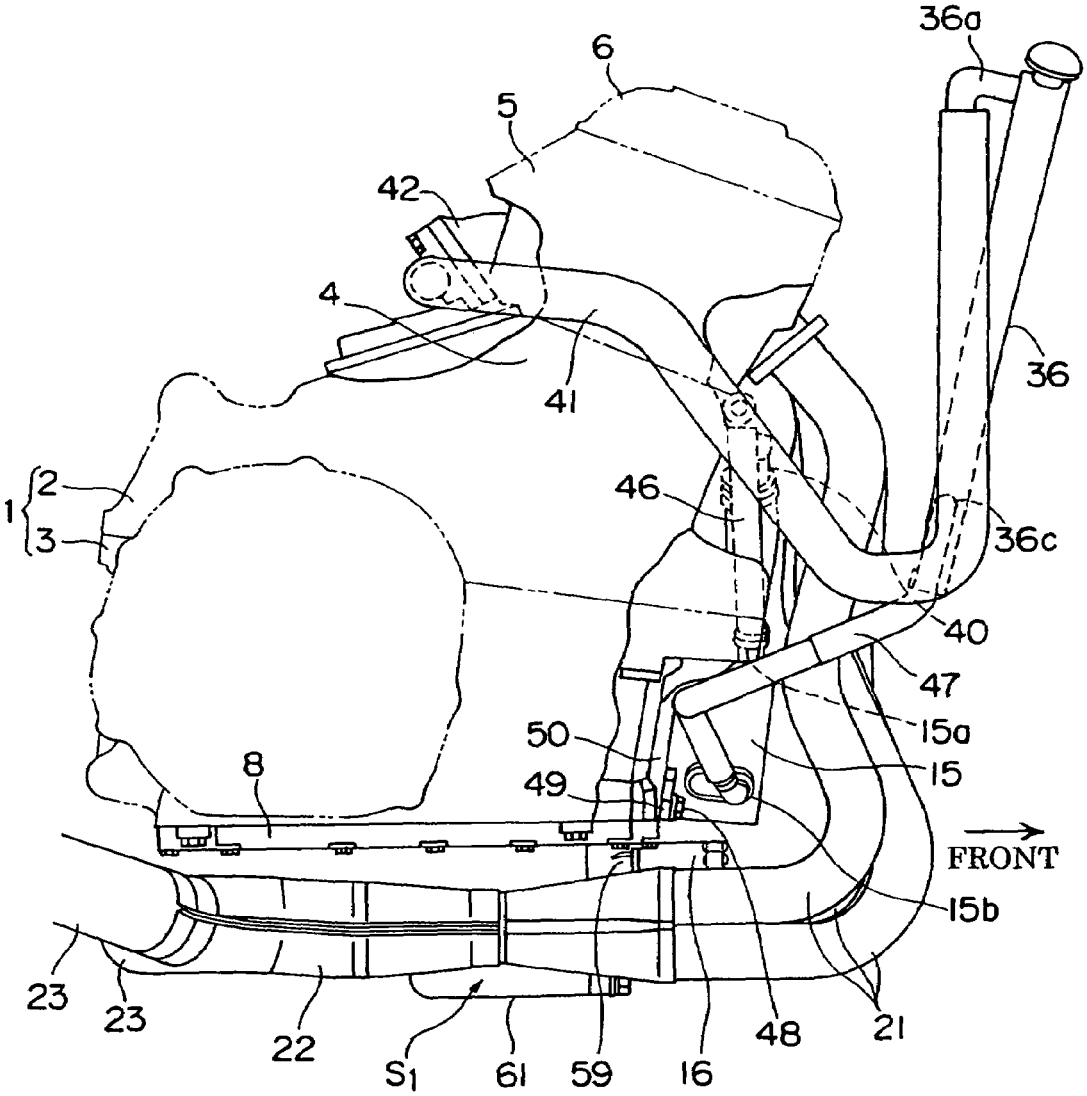
FIG. 3 is a right side elevational view of the engine in FIG. 1.

FIG. 3 is a right side elevational view of the engine. A catalyst pipe 22 extending rearward approximately horizontally from the space portion S1 is arranged in the lower side of the flat shallow portion of the oil pan 8, the focused four exhaust pipes 21 are connected to a front end inlet of the catalyst pipe 22, two right and left exhaust pipes 23 are connected to a rear end of the catalyst pipe 22, and the two exhaust pipes 23 extend to both right and left sides of the rear wheel so as to be respectively connected to the exhaust mufflers.

Structure and Mount of Oil Cooler 15

In FIG. 3, the oil cooler 15 is of a water cooled type, a cooling water inlet 15*a* of the oil cooler 15 is connected to a cooling water inlet portion 40 of the cylinder 4 via a cooling water hose 46, and a cooling water outlet 15*b* is connected to a second cooling water inlet 36*c* of the radiator 36 via a cooling water hose 47.

A plurality of bolt inserting boss portions 49 protruding to an outer side in a radial direction are formed in an outer periphery of a rear end portion of the oil cooler 15, and the oil cooler 15 is detachably mounted to the oil cooler mounting surface 50 formed in the front face of the lower crank case member 3 by bolts 48 inserted to the boss portions 49. The boss portions 49 are formed at positions which are not covered by the exhaust pipe 21 as seen from the front side, as shown in FIG. 2.

Structure and Mount of Oil Filter 16

Figure 4:
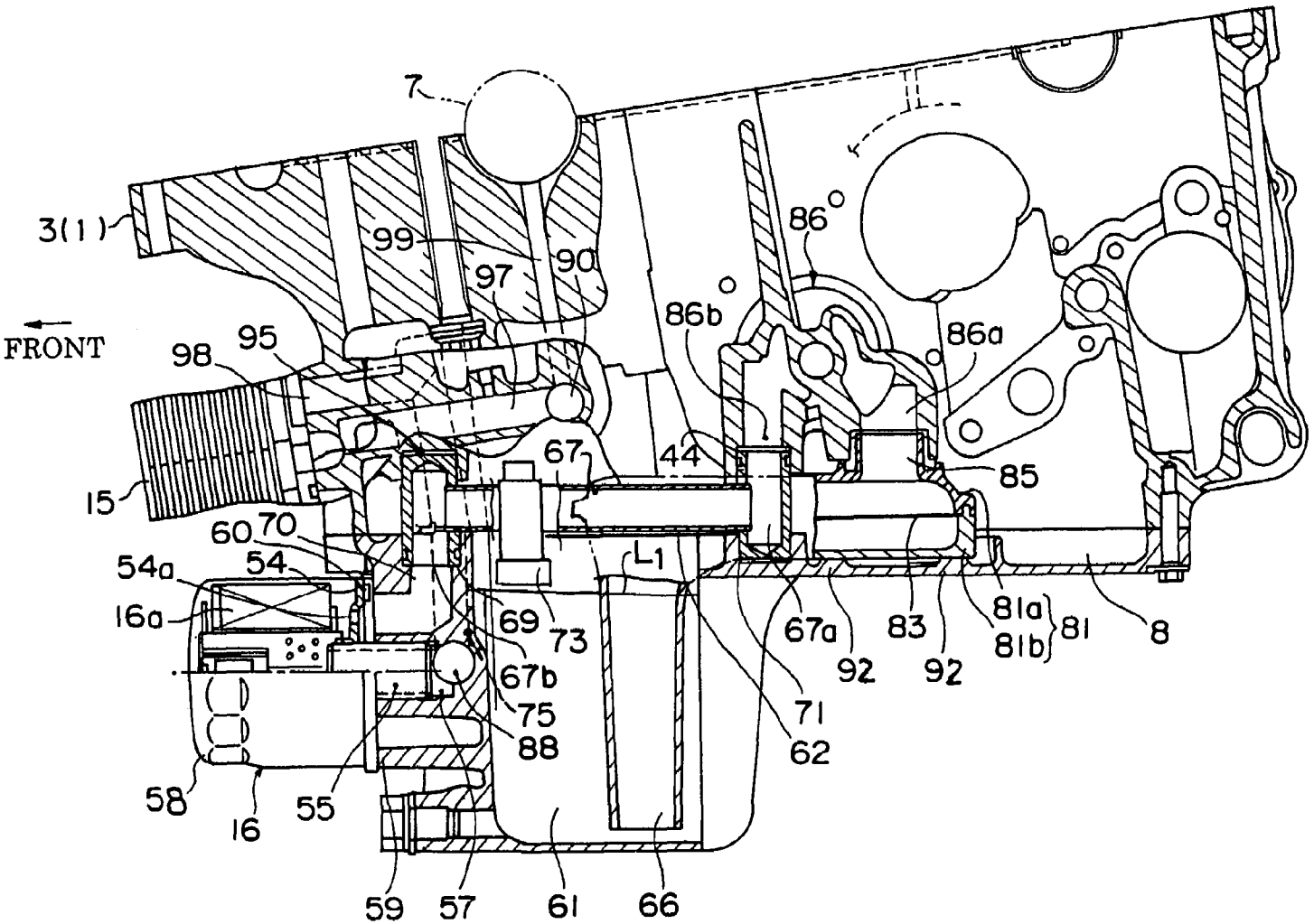
FIG. 4 is a vertical cross sectional side elevational view of a lower crank case member and an oil pan.

FIG. 4 is a vertical cross sectional side elevational view of the lower crank case member 3 and the oil pan 8. In FIG. 4, the oil filter 16 is mainly composed of a closed-end tubular outer case 58, a bottom plate 54 fixed to a rear end of the outer case 58 and having an oil outlet hole 54*a*, an oil outlet pipe 55 fixed to a center of the bottom plate 54 in a penetrating manner, and an annular filter element 16*a* arranged within the outer case 58. An outer peripheral surface of the oil outlet pipe 55 is formed as a male thread portion, and the oil filter 16 is attached to the oil filter mounting surface 59 by screwing the oil outlet pipe 55 to a female thread portion of the oil passage 57 formed in the front face of the concave portion 61 of the oil pan 8. An annular seal (packing) 60 is pinched between the bottom plate 54 and the oil filter mounting surface 59.

Oil Pan and Oil Path

Figure 6:
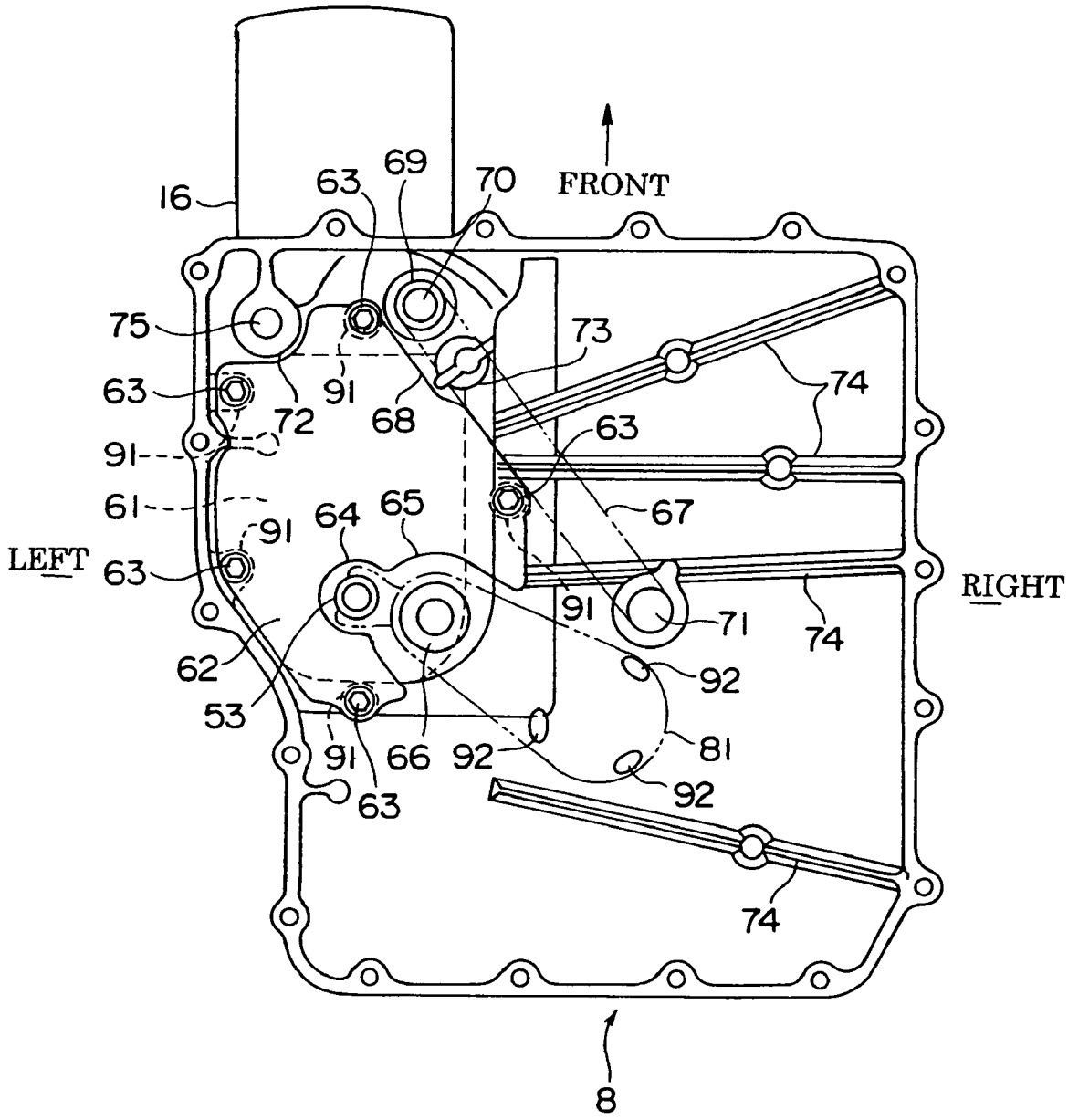
FIG. 6 is a plan view of the oil pan of the engine in FIG. 1.
Figure 7:
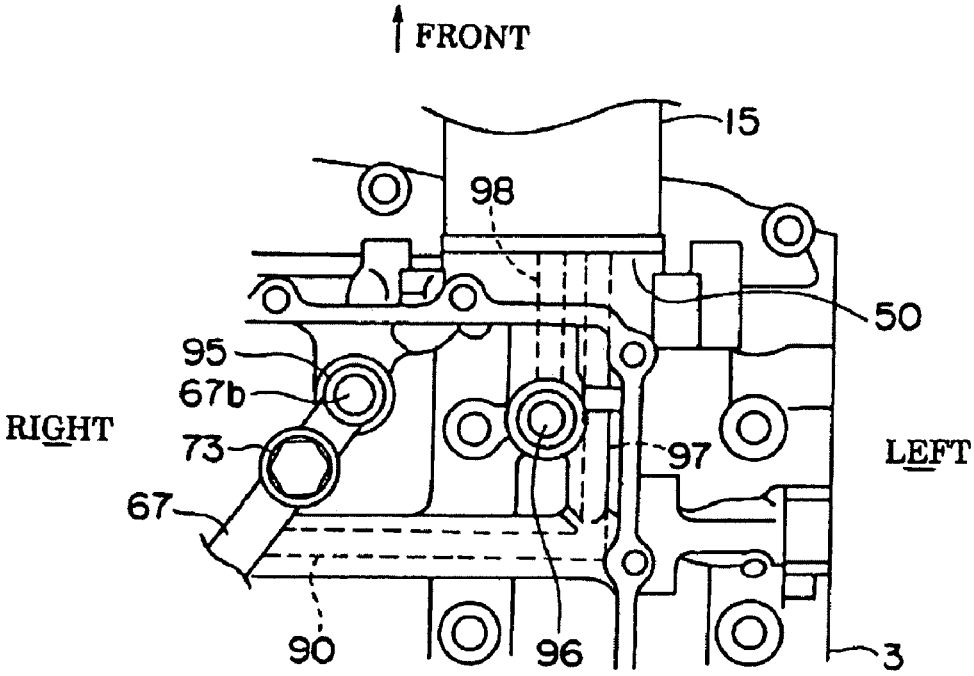
FIG. 7 is a bottom elevational view of a right front end portion of the engine in FIG. 1, and shows the engine in a state in which the oil pan is detached.

FIG. 6 is a plan view of the oil pan 8. The oil pan 8 is formed approximately in a rectangular shape in a plan view, and a left end portion in a front half portion protrudes leftward a little. About half or less of a left region (a region having about a quarter or a fifth part of an entire area of the oil pan) is formed as the concave portion 61, as mentioned above, in a front half portion of the oil pan 8.

In the oil pan 8, an oil passage 75 and an oil passage 70 are formed in left and right end portions of a front end portion of the concave portion 61. The oil passage 75 is communicated with a filtered side space portion of the oil filter 16, and the oil passage 70 is communicated with an unfiltered side space portion of the oil filter 16. Both the oil passages 75 and 70 are formed within tubular walls extending upward from a bottom surface of the oil pan 8 and are open upward. A fitting concave portion 69 for connecting an oil passage pipe 67 is formed coaxially with the oil passage 70 in an upper end portion of the oil passage 70, a fitting concave portion 71 for connecting oil passage pipe 67 is formed at a position spaced at a predetermined distance to a right rear side from the fitting concave portion 69 (near an approximately center position of the oil pan 8), and the fitting concave portion 71 is also formed within an upward protruding tubular wall.

A plurality of guide ribs 74 are formed in the flat shallow portion in the oil pan 8 for guiding the oil within the oil pan 8 into the concave portion 61, and three support projections 92 are formed for supporting a strainer (a primary filter) 81 in a contacting manner from below.

A plurality of upward boss portions 91 for attaching a flat oil level fluctuation preventing plate 62 are formed at intervals around the concave portion 61. The flat oil level fluctuation preventing plate 62 covers an upper side of the concave portion 61 and is mounted on the boss portions 91. The plate 62 is firmly attached to the oil pan 8 by a plurality of bolts 63.

A notch 64 and a notch 65 are formed as a potbellied shape in a plan view in a rear end portion of the oil level fluctuation preventing plate 62, and a notch 68 is formed in a right end portion in a front side of the oil level fluctuation preventing plate 62. The notch 64 is provided for inserting an oil return hose 53 therethrough, the notch 65 is provided for inserting a suction pipe 66 formed in the strainer 81 therethrough, and the notch 68 is provided for arranging the oil passage pipe 67.

Figure 5:
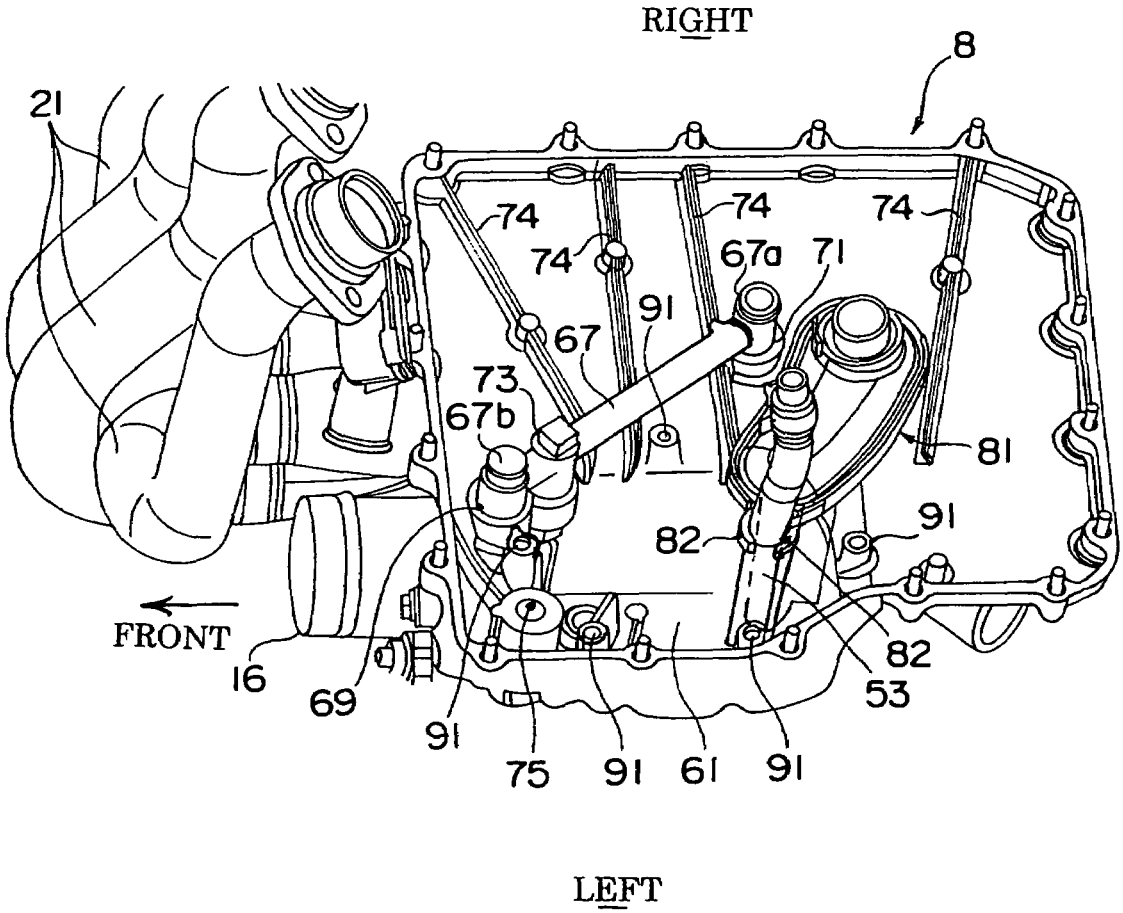
FIG. 5 is a perspective view of the oil pan of the engine in FIG. 1 as seen from the above in a left side front.

FIG. 5 is a perspective view of the oil pan 8 as seen from above at the forward left side. The strainer 81 is arranged so as to extend rearward to a right side from the upper position of the rear end portion of the concave portion 61, and the oil return hose 53 is arranged next to the strainer 81 in the left. The oil return hose 53 is retained by a pair of circular arc shaped clamps 82 integrally formed in a left end of the strainer 81 and extends within the concave portion 61. A lower end of the oil return hose 53 is open to a portion near the bottom surface of the concave portion 61. An upper end portion of the oil return hose 53 is communicated with a lower end oil component discharge hole in the breather chamber 30 via the oil return passages (not shown) formed within the lower crank case member 3 and the upper crank case member 2 in FIG. 1.

Returning to FIG. 5, a tubular oil outlet portion 67*b* opens downward and is formed in a front end of the oil passage pipe 67, the oil outlet portion 67*b* is fitted to the fitting concave portion 69 of the oil pan 8. A tubular oil inlet portion 67*a* opens upward and is formed in a rear end portion of the oil passage pipe 67, and the oil inlet portion 67*a* is fitted to the fitting concave portion 71 of the oil pan 8. A relief valve 73 facing the concave portion 61 is provided in the middle of the oil passage pipe 67.

In FIG. 4, the front end of oil outlet portion 67*b* of the oil passage pipe 67 is pinched (fixed) from above and below respectively, between a fitting concave portion 95 formed in the lower crank case member 3 and the fitting concave portion 69 of the oil pan 8 by fastening the oil pan 8 to the lower surface of the lower crank case member 3. The rear end of oil inlet portion 67*a* is also pinched (fixed) from above and below, respectively, between a fitting concave portion 44 of a discharge port 86*b* of the oil pump 86 provided within the lower crank case member 3 and the fitting concave portion 71 of the oil pan 8.

An outer shell of the strainer 81 is structured as a vertically two-piece divided structure, and a plate shaped net filter element 83 is pinched (fixed) between upper and lower case members 81*a* and 81*b*. The suction pipe 66 integrally formed in a front end portion of the strainer 81 extends downward within the concave portion 61, and is open near the bottom surface of the concave portion 61. An upper end of oil outlet 85 of the strainer 81 is connected to an oil suction port 86*a* of the oil pump 86. The strainer 81 is pinched (fixed) from above and below, respectively between the oil suction port 86*a* of the oil pump 86 and the support projections 92 of the oil pan 8 by fastening the oil pan 8 to the lower surface of the lower crank case member 3.

The discharge port 86*b* of the oil pump 86 opens downward, and is connected to the rear end of oil inlet portion 67*a* of the oil passage pipe 67 as mentioned above. The oil outlet portion 67*b* of the oil passage pipe 67 is communicated with the unfiltered side space portion of the oil filter 16 via the oil passage 70 as mentioned above. The filtered side space portion in the inner portion of the annular filter element 16*a* is communicated with an oil passage 96 in the lower crank case member 3 shown in FIG. 7 via the oil outlet pipe 55, the oil passage 57, an oil passage 88 and the upward oil passage 75 shown in FIG. 5. The oil passage 96 is communicated with the oil inlet of the oil cooler 15 via an oil passage 98 extending forward. The oil outlet in the oil cooler 15 is communicated with a main gallery 90 via an oil passage 97 extending rearward. The main gallery 90 is communicated with a bearing portion in the crank shaft 7 via an oil passage 99 formed within a journal support wall shown in FIG. 4 and extending upward, and is communicated with the other lubricated positions, for example, a transmission mechanism and the like which are not illustrated.

Oil Circulation During Engine Operation

In FIG. 4, during the engine operation, the oil (having an oil level L1) within the concave portion 61 of the oil pan 8 passes through the inner side of the suction pipe 66 and the strainer 81, and is sucked into the oil pump 86 from the oil suction port 86*a*, and the oil pressurized by the oil pump 86 comes into the oil filter 16 from the oil inlet hole 54*a* through the oil passage pipe 67 and the oil passage 70 within the front wall of the oil pan 8, and is filtered by the filter element 16*a*. The filtered oil passes through the oil passages 88 and 75 within the front wall of the oil pan 8 from the oil outlet pipe 55 in the center portion of the oil filter 16 and then comes into the oil cooler 15 from the axial core portion of the oil cooler 15 through the oil passages 96 and 98 within the wall of the lower crank case member 3 shown in FIG. 7, and is cooled on the basis of a heat exchange with the cooling water. The cooled oil comes into the main gallery 90 from the oil passage 97 formed in the side wall of the lower crank case member 3, and is pressure fed to each of the lubricating positions via various oil passages. Further, after lubricating each of the lubricating positions, the oil is returned to the oil pan 8 (FIG. 5).

Circulation of Cooling Water During Engine Operation

In FIG. 1, the cooling water sucked into the cooling water pump 13 from the cooling water outlet 36*b* of the radiator 36 via the cooling water hose 38 is pressure fed to the cooling water inlet portion 40 of the cylinder 4 from the cooling water discharge portion 13*b* via the cooling water hose 39. Most of the water is supplied to the cooling water jacket of the cylinder head 5 from the cooling water jacket within the cylinder 4 so as to cool the cylinder 4, the cylinder head 5 and the like, and the used cooling water is returned to the cooling water inlet 36*a* of the radiator 36 from the cooling water outlet portion 42 via the cooling water hose 41, if the thermostat 43 is open.

In FIG. 2, a part of the cooling water supplied to the cooling water inlet portion 40 of the cylinder 4 is supplied to the oil cooler 15 via the cooling water hose 46, and is returned to the radiator 36 (FIG. 3) via the cooling water hose 47 after cooling the oil.

Attachment Detachment of Oil Filter 16 and Oil Cooler 15

In FIG. 4, in the oil filter 16, the outlet pipe 55 is detached from the female thread portion of the oil passage 57 by rotating the oil filter 16. In this detaching work, the front side of the oil filter 16 is not covered by the exhaust pipe 21 as is apparent from FIG. 2. Accordingly, the worker can easily detach the oil filter 16 from the front side.

The oil cooler 15 is detached from the lower crank case member 3 by detaching the bolt 48 by a tool from the front side. In this detaching work, since each of the bolts 48 is positioned at a position which is not covered by the exhaust pipe 21 from the front side, the worker can easily detach the bolts 48 from the front side, and can take out the oil cooler 15 as it is after detaching the bolts 48. In this case, the cooling water hose 39 covers a part of the left bolt 48 from the front side, however, since the cooling water hose 39 is made of a flexible rubber or the like, it can be easily bent, and does not form an obstacle to the detachment of the oil cooler 15.

Operation and Effect of Embodiment (1) As shown in FIG. 2, since the oil filter 16 is attached to the front face of the oil pan 8 at the lower side of the lower crank case member 3, it is possible to form the front side of the oil filter 16 as an empty space without having to complicate the shape and the layout of the exhaust pipes 21 arranged at the front side of the engine. Accordingly, a worker can easily attach and detach the oil filter 16 from the front side without being disturbed by having to remove the exhaust pipes 21 in replacing the oil filter 16. Particularly, since the oil filter 16, in accordance with the embodiment, is structured such that the outlet pipe 55 having the male thread portion is directly screwed to the female thread portion in the oil passage 57 of the oil pan 8 as shown in FIG. 4, it is necessary to secure a space in the longitudinal direction which is equal to or more than the screw length of the thread portion in the front side of the oil filter 16 in order to attach and detach the oil filter 16. However, since the exhaust pipe 21 is not arranged in the front side of the oil filter 16, it is possible to easily attach and detach the oil filter 16 from the front side.

(2) In FIG. 2, since the oil filter 16 is attached to the front face of the oil pan 8 so as to protrude forward, a larger bank angle is possible in comparison to the case where the oil filter 16 is attached to the right and left side surfaces of the oil pan 8 so as to protrude sideward. For example, a motor cycle having an engine according to the present invention may be provided with a larger bank angle.

(3) In FIG. 2, the oil cooler 15 attached to the front face of the lower crank case member 3 is partly covered by the exhaust pipe 21 from the front side. However, since the oil cooler 15 in the embodiment is structured so as to be attached by the bolts 48, and the exhaust pipe 21 is not arranged in front of the bolts 48 nor the boss portions 49, it is possible to easily detach the bolts 48 by inserting a hexagonal wrench, a box wrench or the like from the front side, and the oil cooler 15 can be thereafter easily detached and moved to the lower side or the front side.

Figure 8:
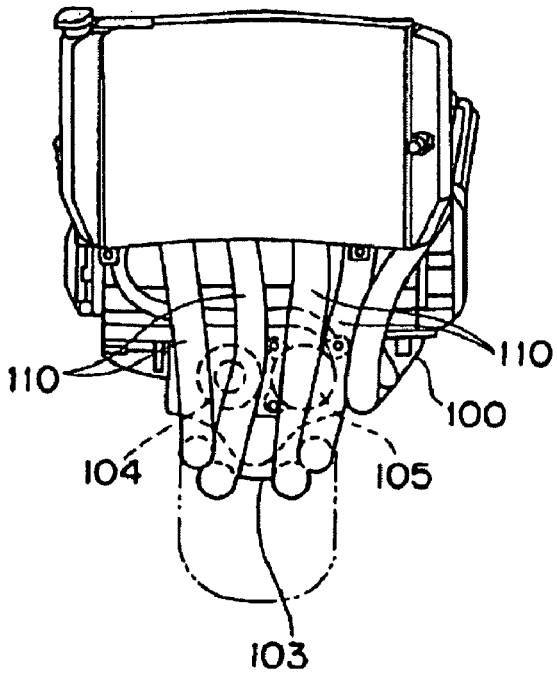
Fig. 8 (Prior Art)
FIG. 8 is a front elevational view of a prior art.

(4) In FIG. 2, since both the oil cooler 15 and the oil filter 16 are arranged close to the left end portion of the engine, and are arranged so as to partly overlap each other in the lateral direction, the lower side oil filter 16 can be exposed to the front side and the upper side oil cooler 15 can be mostly exposed and only partly concealed, by curving only the left end of exhaust pipe 21. In comparison, the oil filter 104 and the oil cooler 105 (FIG. 8) are both concealed when they are arranged side to side in the front face of the lower portion of the crank case as in the conventional structure. Accordingly, the shape and the layout of the exhaust pipe 21 are not complicated and it is easy to manufacture the exhaust pipe 21. Also, the length of the exhaust path is shortened.

(5) In FIG. 4, since the oil supply path is formed from the discharge port 86*b* of the oil pump 86 provided in the lower crank case member 3 to the front wall of the oil pan 8 to which the oil filter 16 is attached, and the oil supply path is structured by the oil passage pipe 67 which is independent from the crank case 1 and the oil pan 8, it is possible to simplify the shapes of the lower crank case member 3 and the oil pan 8. For example, in comparison with the case that the oil passage is formed within the side wall of the lower crank case member 3, the structure of an engine according to the pin is more simple and moreover, is easy to manufacture. In this connection, if it is intended to form the oil passage from the discharge port 86*b* of the oil pump 86 to the front wall of the oil pan 8 within the side wall of the lower crank case member 3, it is necessary to use a long die casting pin as a core for forming the oil passage. Thus, there is a possibility that the pin could be deflected or broken off at a time of casting, and moreover, manufacturing becomes complicated.

(6) In FIG. 4, since the relief valve 73 is provided in the oil passage pipe 67 which is independent from the lower crank case member 3 and the oil pan 8, it is not necessary to form the relief valve mounting portion in the crank case 1 or the oil pan 8, and thus, it is possible to prevent the shapes of the crank case 1 and the oil pan 8 from being complicated. Also, it is possible to easily manufacture the relief valve 73.

(7) In FIG. 4, since the oil passage pipe 67 is fixed at the predetermined position by pinching the front and rear tubular outlet portion 67*b* and inlet portion 67*a* by the respective fitting concave portions 95, 44, 69 and 71 formed in the lower crank case member 3 and the oil pan 8 from above and below, no specific fixing metal member is necessary, and thus, it is possible to simultaneously fix oil passage pipe 67 in accordance with the assembling work of the oil pan 8, and moreover, it is easy to attach and detach the oil passage pipe 67.

(8) In FIG. 4, since the oil passage pipe 67 is arranged approximately at the same height as the mating face between the lower crank case member 3 and the oil pan 8 and is provided with the relief valve 73, the relief valve 73 faces to the concave portion 61 from above. Thus it is possible to directly return the oil relieved from the relief valve 73 into the oil pan 8, at a time when the oil stays within the oil cooler 15, for example, in a cold time. Further, even if air biting is generated in the oil pump 86, it is possible to quickly relieve the air by the relief valve 73 just after the oil is discharged from the oil pump 86.

Other Embodiments (1) In the embodiment mentioned above, the oil filter 16 is attached to the front face of the oil pan 8, and the oil cooler 15 is attached to the front face of the lower crank case member 3, as shown in FIG. 2. On the contrary, the structure may be made such that the oil cooler 15 is attached to the front face of the oil pan 8, and the oil filter 16 is attached to the front face of the lower crank case member 3. In this case, a fixing structure may be formed in the lower side such that the oil cooler 15 is fixed by screwing the male thread portion provided in the center portion of the oil cooler 15 to the female thread portion of the oil pan, and on the other hand a fixing structure may be formed in the upper side such that, the oil filter 16 is fixed by a boss portion and a bolt.

(2) The structure may be made such that the oil filter and/or the oil cooler is attached to any side surface of the right and left sides of the oil pan. In accordance with this structure, the exhaust pipe does not form an obstacle at all, and it is possible to execute the work of replacing of the oil filter and/or the oil cooler from the side portion of the vehicle body.

(3) The structure may be made such that the oil filter and/or the oil cooler is attached to the rear face of the oil pan. In accordance with this structure, the exhaust pipe does not form an obstacle at all, and it is possible to execute the work of replacing the oil filter and/or the oil cooler from the rear side of the vehicle body.

The engine for a vehicle in accordance with the present invention can be applied to an engine for a vehicle such as a saddle riding type four-wheeled vehicle in addition to a motor cycle.

Although the invention has been described in its preferred embodiments with a certain degree of particularity, obviously many changes and variations are possible therein. It is therefore to be understood that the present invention may be practical when configured otherwise than as specifically described herein without departing from the scope and spirit thereof.

What is claimed is:

1. An engine for a motorcycle, comprising:

a crank case;

a cylinder head provided at an upper side of the crank case and having a front face which faces in the same direction as a forward direction of travel of the motorcycle, an exhaust passage outlet in the front face of the cylinder head;

an oil pan formed independently of the crank case and attached to a lower surface of the crank case for reserving lubricating oil of the engine therein, the oil pan having a lateral dimension perpendicular to the forward direction of travel of the motorcycle, a shallow portion with a flat lower surface and a concave portion forming a main oil reservoir;

the shallow portion having left and right lateral end portions and the concave portion being positioned adjacent to one of the left and right lateral end portions and extending from the one of the left and right lateral end portions to a lateral end portion of the crank case;

an oil supply path communicating the oil pan with lubricated positions of the engine;

an oil pump drawing the oil from the oil pan and pressure feeding the oil to the lubricated positions via the oil supply path so as to circulate the oil in the oil pan; and an oil filter interposed in the oil supply path and mounted to a front face of the concave portion of the oil pan;

wherein a width of the concave portion in the left and right lateral direction is approximately equal to or less than about one half of the entire width of the oil pan in the left and right lateral direction; and wherein the concave portion includes a side surface, the side surface and the lower surface of the shallow portion forming a space for permitting an exhaust pipe to pass through.

2. The motorcycle engine as claimed in claim 1, wherein the oil pump includes a suction port and a discharge port, and is positioned above the flat shallow portion of the oil pan, and the oil supply path includes a suction path portion extending from a bottom of the oil pan to the suction port of the oil pump, the suction path portion including an upwardly extending suction pipe portion having an opening near a bottom surface of the concave portion and extending upwardly to an upper end, and a horizontal suction pipe portion extending horizontally within the shallow portion of the oil pan, the horizontal suction pipe portion having a first end connected to the upper end of the upwardly extending suction pipe portion and a second end connected to the suction port of the oil pump; and a discharge path portion extending from the discharge port of the oil pump to the oil filter, the discharge path portion including an oil passage pipe extending horizontally within a space between a bottom portion of the crank case and the oil pan, the oil passage pipe having an upstream end connected to the discharge port of the oil pump and a downstream end connected to the oil filter.

3. The motorcycle engine as claimed in claim 2, wherein the downstream end of the oil passage pipe includes a tubular end portion having a downwardly facing opening in fluid communication with the oil filter;

the upstream end of the oil passage pipe includes a tubular end portion having an upwardly facing opening in fluid communication with the discharge port of the oil pump; and each tubular end portion is fixed between the crank case and the oil pan from above and below, respectively.

4. The motorcycle engine as claimed in claim 2, wherein a relief valve is provided in the oil passage pipe.

5. The motorcycle engine of claim 2, wherein the horizontal suction pipe portion includes a strainer having an upper case member and a lower case member, the strainer accommodating a filter element fixed between the upper and lower case members from above and below, respectively.

6. The motorcycle engine as claimed in claim 5, wherein the upper and lower case members of the strainer are fixed between a bottom, surface of the crankcase and a bottom wall of the shallow portion of the oil pan.

7. The motorcycle engine as claimed in claim 1, further comprising:

an oil cooler attached to the front face of the lower portion of the crank case, the oil filter and the oil cooler being arranged in such a manner as to at least partly overlap in the lateral direction.

8. The motorcycle engine of claim 1, wherein the lower surface of the shallow portion is substantially perpendicular to a side surface of the concave portion.

* * * * *